US011054178B2

(12) United States Patent
Mevada et al.

(10) Patent No.: US 11,054,178 B2
(45) Date of Patent: Jul. 6, 2021

(54) CRANKCASE OIL SEPARATION FOR HIGH PRESSURE RECIPROCATING COMPRESSORS

(71) Applicant: Vilter Manufacturing LLC, Cudahy, WI (US)

(72) Inventors: Girish Natvarlal Mevada, Pune (IN); Pruthviraj Nagnath Pawar, Pune (IN); Jean-Louis Picouet, Waukesha, WI (US); Steven M. Cihlar, Cudahy, WI (US); David H. Anderson, Hubertus, WI (US)

(73) Assignee: Vilter Manufacturing LLC, Cudahy, WI (US)

( * ) Notice: Subject to any disclaimer, the term of this patent is extended or adjusted under 35 U.S.C. 154(b) by 328 days.

(21) Appl. No.: 16/190,343

(22) Filed: Nov. 14, 2018

(65) Prior Publication Data

US 2019/0145678 A1 May 16, 2019

Related U.S. Application Data

(60) Provisional application No. 62/586,656, filed on Nov. 15, 2017.

(51) Int. Cl.
*F25B 43/02* (2006.01)
*F01M 13/04* (2006.01)

(52) U.S. Cl.
CPC ..... *F25B 43/02* (2013.01); *F01M 13/04* (2013.01); *F01M 2013/0477* (2013.01)

(58) Field of Classification Search
CPC .. F25B 43/02; F01M 13/04; F01M 2013/0477
See application file for complete search history.

(56) References Cited

U.S. PATENT DOCUMENTS 2,074,323 A 3/1937 Borgerd
2,844,305 A * 7/1958 Becht ..... F25B 31/002 92/78

(Continued)

FOREIGN PATENT DOCUMENTS

| | | |
|---|---|---|
| DE | 10362162 | 4/2008 |
| JP | S61118591 | 6/1986 |
| JP | H05195975 | 8/1993 |

OTHER PUBLICATIONS

Office Action from the Intellectual Property Office of India for Application No. 201844042734 dated Jun. 8, 2020 (6 pages).

*Primary Examiner* — Ana M Vazquez
(74) *Attorney, Agent, or Firm* — SmithAmundsen LLC

(57) ABSTRACT

An oil separation assembly for use in a high pressure reciprocating compressor is provided. The compressor includes a suction chamber, a crankcase chamber, and at least one partition member at least partially separating the suction chamber and the crankcase chamber. The at least one partition member includes at least one opening. The oil separation assembly can include at least one demisting structure positioned within the crankcase chamber adjacent the at least one partition member at the at least one opening. At least one securing structure can be secured in operable relation with the at least one demisting structure so as to secure the at least one demisting structure relative to the opening. The oil separation assembly can further include a second demisting structure positioned within the suction chamber adjacent the at least one partition member at the at least one opening.

8 Claims, 5 Drawing Sheets

(56) References Cited

U.S. PATENT DOCUMENTS

| | | | | |
|---|---|---|---|---|
| 3,016,184 | A | | 1/1962 | Hart |
| 3,684,412 | A | | 8/1972 | Harlin et al. |
| 4,280,799 | A | | 7/1981 | Struve et al. |
| 4,741,177 | A | | 5/1988 | Glanvall |
| 4,799,869 | A | | 1/1989 | Cordiano et al. |
| 4,887,514 | A | * | 12/1989 | Schintgen ..... F04B 39/121 92/79 |
| 5,090,873 | A | | 2/1992 | Fain |
| 5,246,357 | A | | 9/1993 | Sjoholm et al. |
| 5,417,184 | A | | 5/1995 | McDowell |
| 5,733,107 | A | | 3/1998 | Ikeda et al. |
| 6,082,981 | A | | 7/2000 | Nakajima et al. |
| 6,206,653 | B1 | | 3/2001 | Dewhirst et al. |
| 6,237,362 | B1 | | 5/2001 | Jang et al. |
| 6,736,623 | B2 | | 5/2004 | Li et al. |
| 6,872,065 | B1 | | 3/2005 | Shimada et al. |
| 7,060,122 | B2 | | 6/2006 | Bhatia et al. |
| 7,082,785 | B2 | | 8/2006 | Nieter et al. |
| 8,597,005 | B2 | | 12/2013 | Nomura et al. |
| 2007/0175239 | A1 | | 8/2007 | Inoue |
| 2015/0345349 | A1 | | 3/2015 | Monros |

* cited by examiner

CRANKCASE OIL SEPARATION FOR HIGH PRESSURE RECIPROCATING COMPRESSORS

FIELD OF THE DISCLOSURE

The present disclosure relates, generally, to the field of reciprocating compressors. More particularly, the present disclosure relates to an oil separation assembly and high pressure reciprocating compressors including the same.

BACKGROUND

Reciprocating compressors generally have a housing with a partition member, such as a wall, which divides the space within the housing into a suction chamber and a crankcase chamber, the lowest portion of which serves as an oil sump. The partition member is provided with relatively large openings in which cylinder sleeves are mounted and pistons are slidably mounted for reciprocating motion in the cylinder sleeves to compress gas passing through the suction chamber. The pistons are connected by connecting rods, which are provided with connecting rod bearings, to a crankshaft which is rotatably mounted on crankshaft bearings in the lower crankcase chamber. The partition member also supports capacity reduction mechanisms which are located in the upper suction chamber and which operate gas inlet valves which are located at the upper ends of the cylinder sleeves. The partition also includes one or more small pressure equalizers or vent holes which serve to provide for gas pressure equalization between the suction chamber and the crankcase chamber. The pressure equalizers or vent holes also serve to drain oil collected in the suction chamber to the crankcase chamber. The pressure equalizers or vent holes may include pressure relief valves.

During compressor operation, lubricating oil is supplied under pressure through passages in the housing, crankshaft and piston rods to the connecting rod bearings and crankshaft bearings in the crankcase. As oil drains out of the bearings during crankshaft rotation, oil droplets are sprayed about the crankcase chamber and eventually drain into the oil sump from whence the oil is recovered and recirculated. Because of the "blow-by" phenomena which occurs as the pistons compress the gas, some gas leaks past the pistons and rings and tends to pressurize the crankcase. As this gas is vented back to the suction chamber, it carries oil mist through the vent hole into the suction chamber where they mix with the gas being drawn into the cylinders compressed and expelled into the system. This is undesirable for two reasons. Frist, most of such oil is lost into the refrigeration system and is no longer available in the sump for lubrication purposes. Over time, the amount of oil lost is substantial and is costly to replace. Second, such oil contaminates both the refrigerant gas and the refrigeration system and reduces system efficiency.

As a practical matter, some of the oil mist coalesces in the suction chamber and collects on the partition member but is able to drain back into the crankcase chamber through the pressure equalizer hole and into the oil sump therein. However, oil dripping or draining through the pressure equalizer hole falls onto the rotating crankshaft and is sprayed about the crankcase chamber in the form of mist causing some mist to be expelled up through the pressure equalizer hole back into the suction chamber.

For at least these reasons, therefore, it would be advantageous if a new or improved oil separation assembly could be developed that addressed one or more of the above-described concerns, and/or other concerns.

SUMMARY

The present disclosure provides an oil separation assembly for use in a high pressure reciprocating compressor. According to embodiments of the present disclosure, the compressor comprising a suction chamber, a crankcase chamber, and at least one partition member at least partially separating the suction chamber and the crankcase chamber, the at least one partition member including at least one opening, and the oil separation assembly comprises at least one demisting structure positioned within the crankcase chamber adjacent the at least one partition member at the at least one opening; and at least one securing structure secured in operable relation with the at least one demisting structure so as to secure the at least one demisting structure relative to the opening.

In another embodiment, the present disclosure provides a high pressure reciprocating compressor. According to embodiments of the present disclosure, the high pressure reciprocating compressor comprises a suction chamber; a crankcase chamber; a partition member at least partially separating the suction chamber and the crankcase chamber and comprising at least one opening; and at least one oil separation assembly comprising a first demisting structure positioned in the crankcase chamber adjacent the partition member at the at least one opening, and at least one securing structure secured in operable relation with the first demisting structure so as to secure the first demisting structure relative to the opening.

BRIEF DESCRIPTION OF THE DRAWINGS

Embodiments of the crankcase oil separation assembly and related methods are disclosed with reference to the accompanying drawings and are for illustrative purposes only. The crankcase oil separation assembly and related methods are not limited in application to the details of construction or the arrangement of the components illustrated in the drawings. The crankcase oil separation assembly and related methods are capable of other embodiments or of being practiced or carried out in other various ways. Like reference numerals are used to indicate like components. In the drawings.

DETAILED DESCRIPTION

Figure 1:
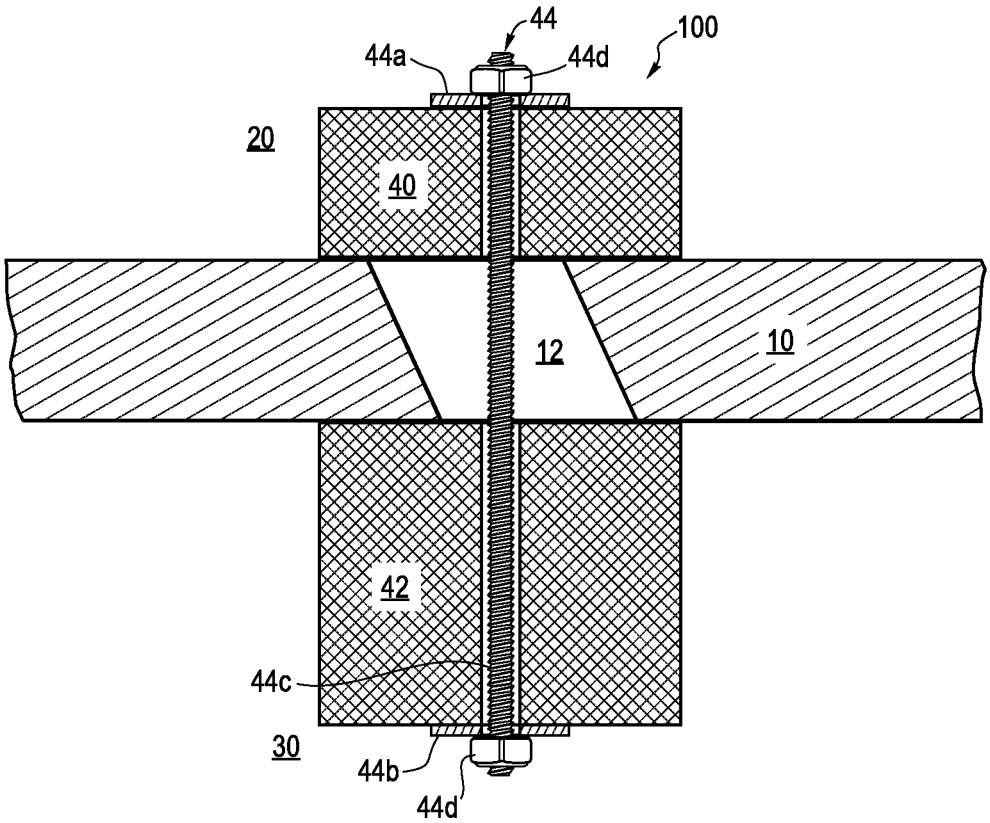
FIG. 1 is a cross-sectional view of an exemplary oil separation assembly in accordance with embodiments of the present disclosure.

FIG. 1 is a cross-sectional schematic of an oil separation assembly 100 for use in a reciprocating compressor in accordance with embodiments of the present disclosure. As shown in FIG. 1, the reciprocating compressor includes a partition member 10 which separates the suction chamber 20 and the crankcase chamber 30. The partition member 10 includes at least one opening 12 through which oil and refrigerant may flow. To reduce or hinder the flow of oil from the crankcase chamber 30 to the suction chamber 20 through the opening 12, the oil separation assembly 100 is positioned to cover both the suction chamber-side and crankcase chamber-side of the opening 12.

In the embodiment shown, the oil separation assembly 100 includes a suction chamber-side demisting structure 40 and a crankcase chamber-side demisting structure 42. The demisting structures 40, 42 are materials or assemblies, or combinations thereof, used to enhance the removal of liquid droplets of oil from the gaseous refrigerant stream. The demisting structures 40, 42 may be the same structures or different structures.

Nonlimiting examples of suitable demisting structures include materials such as mesh-type coalescers, including wire mesh-type coalescers (e.g., steel wool), mesh-type materials made of natural or synthetic fibers, other similar mesh-like materials, serpentine channels, and steel or stainless mesh. In still further embodiments, one of the demisting structures 40, 42 may be a combination of one or more demisting materials used in combination with one or more demisting structures, such as, for example, serpentine channels packed with a demisting material such as steel wool.

In one embodiment, at least one of the demisting structures 40, 42 is a material having a thickness $T_{40}$, $T_{42}$. In some embodiment, the thickness of the demisting structures 40, 42, particularly when one or both of the demisting structures is a mesh-type coalescer or other material, may be specifically selected based on the size of the opening 12 and/or the capacity, performance, or other metric of the compressor.

As liquid droplets of oil pass through the demisting structures 40, 42, the liquid droplets coalesce until they are too large and/or heavy to be sustained within the demisting structures 40, 42. The coalesced oil droplets then drop into the crankcase chamber 30 and are collected in the oil sump (not shown).

The first and second demisting structures 40, 42 each have a thickness $T_{40}$, $T_{42}$. In the embodiment shown in FIG. 1, the thicknesses $T_{40}$, $T_{42}$ of the demisting structures 40, 42 are unequal. That is, demisting structure 40 has a lesser or smaller thickness $T_{40}$ than that of demisting structure 42. However, in other embodiments, the thicknesses $T_{40}$, $T_{42}$ may be the same, or $T_{40}$ may be greater than $T_{42}$.

The oil separation assembly 100 further includes at least one securing structure 44 which secures the suction chamber-side demisting structure 40, crankcase chamber-side demisting structure 42 or both in position relative to the opening 12. In other words, the at least one securing structure may be a single component or assembly which is secured in operable relation with the suction chamber-side demisting structure and/or crankcase chamber-side demisting structure so as to secure the demisting structure relative to the opening 12.

For example, in the embodiment shown in FIG. 1, the at least one securing structure 44 is a securing assembly comprising a first support 44*a*, a second support 44*b* and a locking structure 44*c*. More particularly, in the embodiment shown, the at least one securing structure 44 includes a first support 44*a* which is a plate, a second support 44*b* which is also a plate, and a locking structure 44*c* which is a locking stud. In the embodiment illustrated in FIG. 1, the first support 44*a* is on the suction chamber-side of the oil separation assembly 100 and adjacent the outer surface of the first demising structure 40 so as to sandwich the first demisting structure 40 between the partition member 10 and the first support 44*a*. Similarly, the second support 44*b* is on the crankcase chamber-side of the oil separation assembly 100 and adjacent the outer surface of the second demisting structure 42 so as to sandwich the second demisting structure 42 between the partition member 10 and the second support 44*b*. The second support 44*b* therefore also serves as a first barrier to prevent or limit large oil droplets from passing through the opening 12. Further, the second support 44*b* acts as a barrier to prevent large droplets of oil from clogging the demisting structures 40, 42.

The locking stud 44*c* passes through the first support 44*a*, first demisting structure 40, the opening 12, the second demisting structure 42 and the second support 44*b* and, along with washers and lock nuts 44*d*, for example, tightens the first and second supports 44*a*, 44*b* toward one another. The first and second demisting structures 40, 42 are thereby compressed against the partition member 10 and secured in position on either side of the opening 12.

While in the embodiment shown, the first support 44*a* is discussed and described with respect to the suction chamber-side of the oil separation assembly and the second support 44*b* is discussed and described with respect to the crankcase chamber-side of the oil separation assembly, it will be understood that the first and second supports 44*a*, 44*b* may be used interchangeably as permitted.

Figure 2:
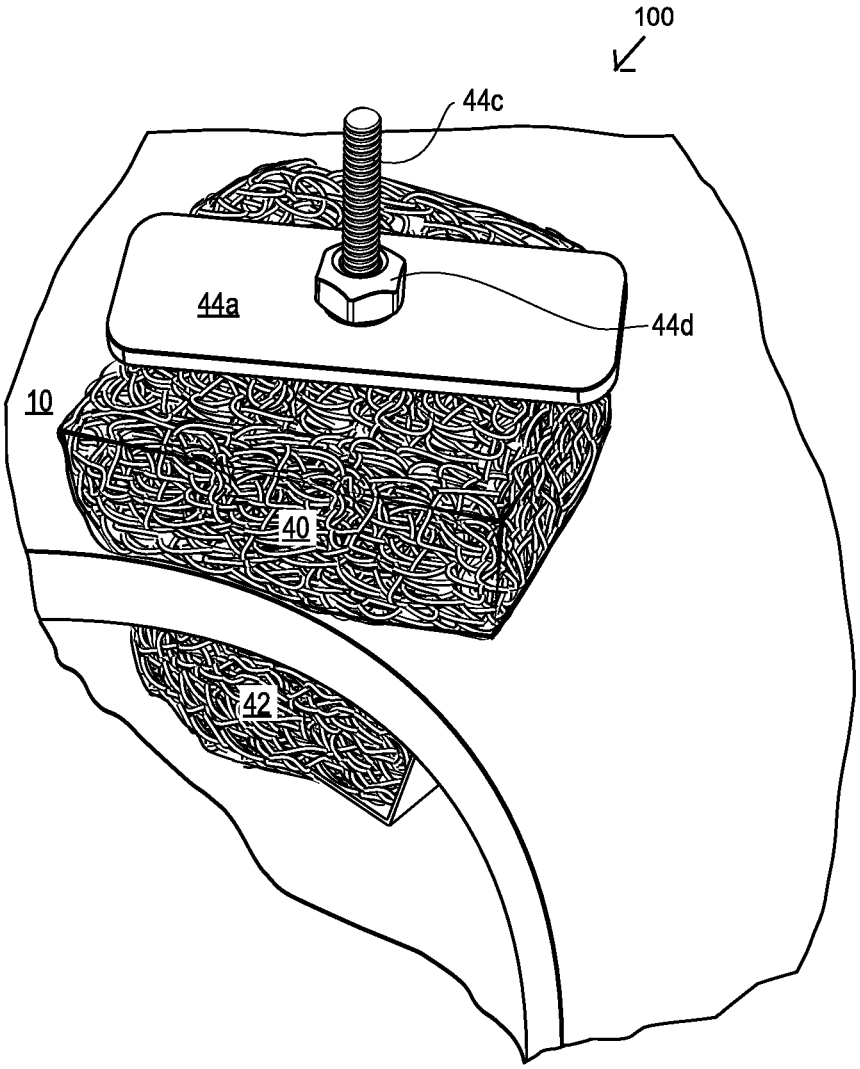
FIG. 2 is a perspective view of the exemplary oil separation assembly of FIG. 1.

FIG. 2 shows the interior of a compressor at the partition member 10 from the suction chamber side showing the oil separation assembly 100 of FIG. 1 in position relative to an opening (not shown). The oil separation assembly 100 includes the first and second demisting structures 40, 42 and the at least one securing structure 44 which includes the first and second supports 44*a*, 44*b* (44*b* not shown) and the locking structure 44*c* with locking nut 44*d*.

Figure 3:
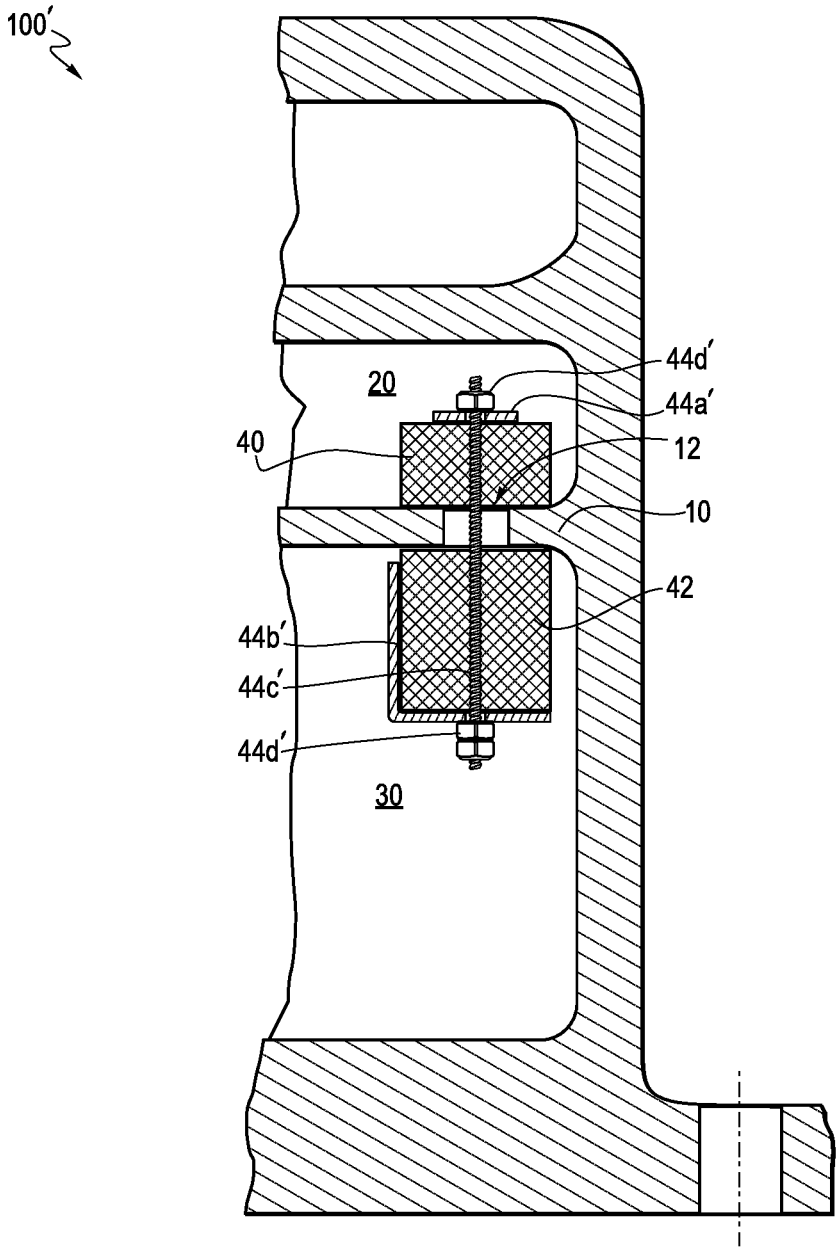
FIG. 3 is a cross-sectional view of a second embodiment of an exemplary oil separation assembly in accordance with embodiments of the present disclosure.
Figure 4:
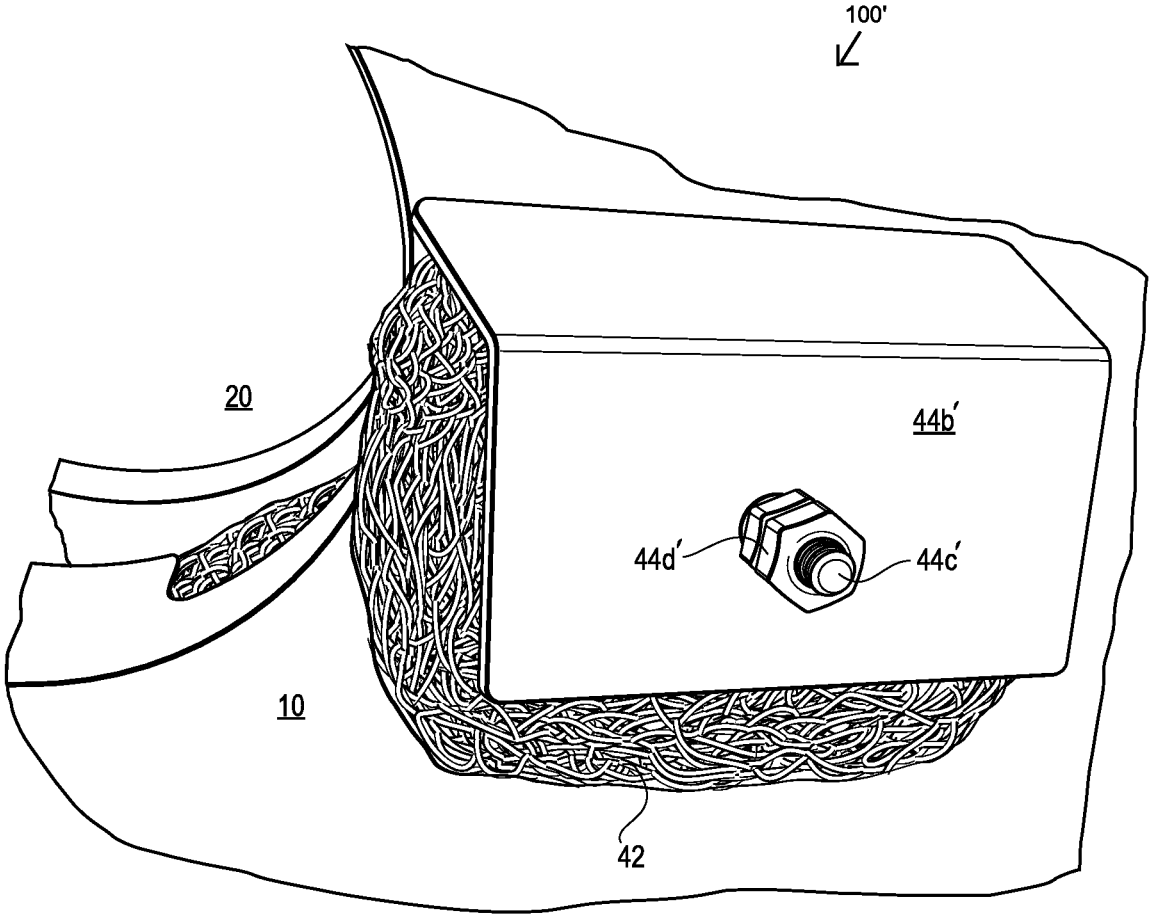
FIG. 4 is a perspective view of the exemplary oil separation assembly of FIG. 2.

FIGS. 3 and 4 illustrate a second embodiment of an oil separation assembly in accordance with embodiments of the present disclosure. Particularly, FIG. 3 is a cross-sectional schematic of an oil separation assembly 100' for use in a reciprocating compressor in accordance with embodiments of the present disclosure and FIG. 4 shows the interior of a compressor at the partition member 10 from the crankcase chamber side showing oil separation assembly 100' secured to the partition member 10 at the opening 12 (not shown).

In the embodiment shown in FIGS. 3 and 4, the suction chamber-side and crankcase chamber-side demisting structures 40, 42 are as described with respect to oil separation assembly 100. The oil separation assembly 100' differs from oil separation assembly 100 in the particular embodiment of the at least one securing structure 44'. As shown in FIGS. 3 and 4, the at least one securing structure 44' includes a first support 44*a*', a second support 44*b*' and a locking structure 44*c*'; however, in the embodiment shown, the first support 44*a*' is a plate and the second support 44*b*' is a baffle plate or cup. Like support structures 44*a* and 44*b*, support structures 44*a*' and 44*b*' are tightened towards one another by locking structure 44*c*' (which in the embodiment shown is a locking stud) to compress the suction chamber-side and crankcase chamber-side demisting structures towards one against the partition member 10. The locking structure 44*c*' can be secured using washers and locking nuts 44*d*'.

Figure 5:
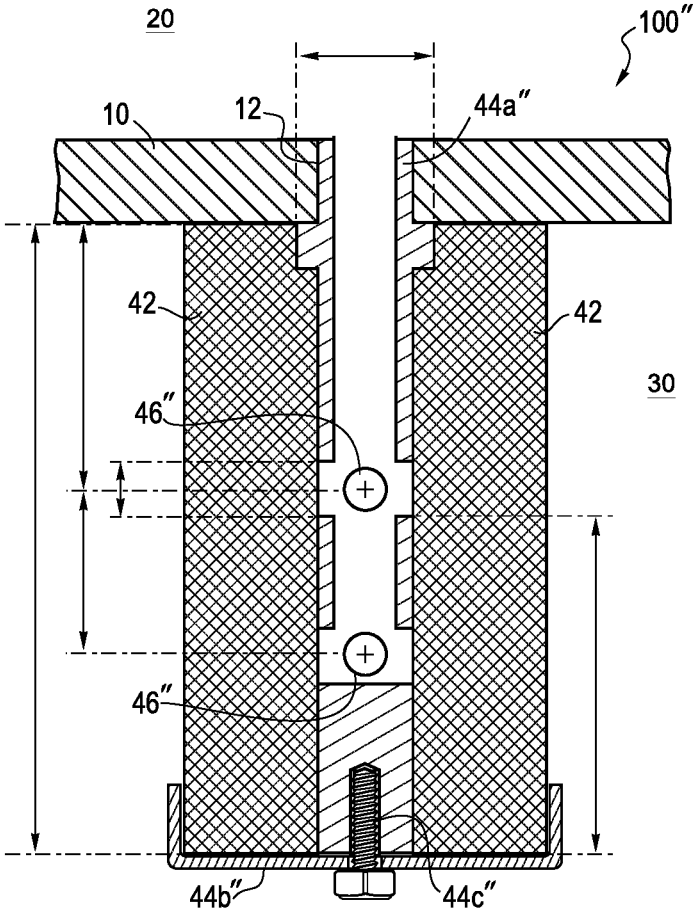
FIG. 5 is a cross-sectional view of a third embodiment of an exemplary oil separation assembly in accordance with embodiments of the present disclosure.

FIG. 5 illustrates a further embodiment of an oil separation assembly 100" in accordance with embodiments of the present disclosure. Particularly, FIG. 5 is a cross-sectional schematic of an oil separation assembly 100" for use in a reciprocating compressor in accordance with embodiments of the present disclosure. As in FIGS. 1-4, the oil separation assembly 100" is shown secured to the partition member 10 and the opening 12. In the embodiments shown in FIGS. 1-4, the oil separation assemblies 100 and 100' include demisting structures 40, 42 on both the suction chamber 20 side of the opening 12 and the crankcase chamber 30 side of the opening 12; however, in the embodiment shown, there is a single demisting structure 42 which is on the crankcase chamber 30 side of the opening 12. The demisting structure 42 may be as described above.

To secure the demisting structure 42 in position, the oil separation assembly 100" includes at least one securing structure 44" which includes a first support 44*a*", a second support 44*b*" and a locking structure 44*c*". More particularly, in the embodiment shown, the first support 44*a*" is a channel-forming support which extends from the opening 12 into the crankcase chamber 30. The first support 44*a*" is a tube-like structure which creates a channel into the crankcase chamber 30 around which the demisting structure may be positioned. The first support 44*a*" also serves as a structure with which the locking structure 44*c*" can engage. To facilitate adequate flow through the suction chamber 20 and crankcase chamber 30, and facilitate pressure equalization between the chambers 20, 30, the embodiment shown in FIG. 5 the first support 44*a*" also includes cross holes 46" to allow gasses to pass through the opening 12 and demisting structure 42. In the embodiment shown in FIG. 5, the second support 44*b*" is a structure which provides a first barrier for larger oil droplet, such as, for example, a plate or a cup as described with reference to FIGS. 1-4, above. The locking structure 44*c*" is a structure which engages the first and second supports 44*a*", 44*b*" to secure the demisting material 42 in position relative to the opening 12. In an embodiment shown, the locking structure 44*c*" is a screw.

One advantage of the oil separation assembly described herein is that the assembly may be installed into existing reciprocating compressors. That is, existing reciprocating compressors may be retrofit with the oil separation assembly of the present disclosure. Existing reciprocating compressors may therefore exhibit the improvements in operation provided by the oil separation assembly.

To install the oil separation assembly in a reciprocating compressor, whether a new compressor or an existing compressor, a first demisting structure is provided at an opening at the partition member of the compressor on the crankcase chamber-side of the opening. If a suction chamber-side demisting structure is to be used, the second demisting is provided at the opening at the suction chamber-side of the opening. The at least one securing structure is then assembled in operable relation to the first (and, if utilized, second) demisting structure(s) to secure the demisting structure(s) in place.

In an embodiment, the at least one securing structure includes a first support, a second support and a locking structure. In such embodiment, the step of assembling the at least one securing structure in operable relation to the first (crankcase chamber-side) demisting structure includes positioning a first support in relation to the demisting structure, positioning a second support in relation to the demisting structure, and securing the first and second supports in position using a locking structure.

In an embodiment, only a crankcase chamber-side demisting material is provided. In such an embodiment, the step of assembling the at least one securing structure in operable relation to the demisting material may include, for example, positioning a first support in relation to the opening at the partition member to extend into the crankcase chamber and into the demisting material, positioning a second support in relation to the demisting material in the crankcase chamber, and securing the first and second supports together in relation to the demisting structure using a locking structure.

In an embodiment in which two demisting structures are used on opposite sides of an opening (i.e., a suction chamber-side demisting material and a crankcase chamber-side demisting material are both used), the step of assembling the at least one securing structure in operable relation to the demisting structures may include, for example, positioning a first support in relation to the suction chamber-side demisting material, positioning a second support in relation to the crankcase chamber-side demisting material, and securing the first and second supports together in relation to the demisting structure using a locking structure.

The oil separation assembly described herein addresses at least three issues. First, the oil separation assembly assists in returning oil collected in the suction chamber back to the crankcase chamber.

Second, the oil separation assembly helps to maintain a pressure equilibrium between the suction chamber and the crankcase chamber.

Third, the oil separation assembly limits the amount of oil passing through the vent holes 12 from the crankcase chamber to the suction chamber when the rotating crankshaft splashes or sprays oil that comes in contact with it.

By (1) assisting in returning oil collected in the suction chamber back to the crankcase chamber, (2) helping to maintain a pressure equilibrium between the suction chamber and crankcase chamber, and (3) limiting the amount of oil passing from the crankcase chamber to the suction chamber, the oil separation assembly decreases oil loss and therefore costs associated with operating and maintaining a reciprocating compressor.

The disclosed oil separation assembly is also easily installed in existing reciprocating compressors at existing vent holes.

Additional advantages of the oil separation assembly will be readily identified and understood by those of skill in the art.

One of skill in the art will understand that the specific measurements (e.g., height, width, diameter, etc.) of the oil separation assembly may vary based on compressor design and the dimensions of the oil separation assembly may be altered accordingly to correspond to the measurements of the compressor.

The terms "comprising," "including," "having," and their derivatives, are not intended to exclude the presence of any additional component, step or procedure, whether or not the same is specifically disclosed.

Unless stated to the contrary, implicit from the context, or customary in the art, all parts and percentages are based on weight and all test methods are current as of the filing date of this disclosure.

It is specifically intended that the crankcase oil separation assembly and related methods not be limited to the embodiments and illustrations contained herein, but include modified forms of those embodiments including portion so the embodiments and combinations of elements of different embodiments as come with the scope of the following claims. In addition, the order of various steps of operation described herein can be varied. Further, numerical ranges provided herein are understood to be exemplary and shall include all possible numerical ranges situated therebetween.

The invention claimed is:

1. An oil separation assembly for use in a high pressure reciprocating compressor, the compressor comprising a suction chamber, a crankcase chamber, and at least one partition member at least partially separating the suction chamber and the crankcase chamber, the at least one partition member including at least one opening, the oil separation assembly comprising:

at least one demisting structure positioned within the crankcase chamber adjacent the at least one partition member at the at least one opening;

a second demisting structure positioned within the suction chamber adjacent the at least one partition member at the at least one opening; and at least one securing structure secured in operable relation with the at least one demisting structure so as to secure the at least one demisting structure relative to the opening;

wherein the at least one demisting structure and the second demisting structures are independently selected from the group consisting of wire mesh, steel wool, stainless mesh, steel mesh, serpentine channels and combinations thereof.

2. The oil separation assembly of claim 1, wherein at least one of the at least one demisting structure and the second demisting structure are steel wool.

3. The oil separation assembly of claim 2, wherein both the at least one demisting structure and the second demisting structure are steel wool.

4. The oil separation assembly of claim 1, wherein the at least one securing structure comprises a first support, a second support, and a locking structure.

5. A high pressure reciprocating compressor comprising:

a suction chamber;

a crankcase chamber;

a partition member at least partially separating the suction chamber and the crankcase chamber and comprising at least one opening; and at least one oil separation assembly comprising a first demisting structure positioned in the crankcase chamber adjacent the partition member at the at least one opening, a second demisting structure positioned within the suction chamber adjacent the at least one partition member at the at least one opening, and at least one securing structure secured in operable relation with the first demisting structure so as to secure the first demisting structure relative to the opening;

wherein the first and second demisting structures are independently selected from the group consisting of wire mesh, steel wool, stainless mesh, steel mesh, serpentine channels and combinations thereof.

6. The compressor of claim 5, wherein at least one of the first and second demisting structures are steel wool.

7. The compressor of claim 5, wherein both the first and second demisting structures are steel wool.

8. The compressor of claim 5, wherein the at least one securing structure comprises a first support, a second support, and a locking structure.

* * * * *